United States Patent [19]

Usui

[11] Patent Number: 5,018,499

[45] Date of Patent: May 28, 1991

[54] FUEL DELIVERY RAIL ASSEMBLY

[75] Inventor: Masayoshi Usui, Numazu, Japan

[73] Assignee: Usui Kokusai Sangyo Kaisha Ltd., Shizuoka, Japan

[21] Appl. No.: 506,184

[22] Filed: Apr. 9, 1990

[30] Foreign Application Priority Data

Apr. 15, 1989 [JP] Japan ..... 1-43628[U]

[51] Int. Cl.[5] ..... F02M 41/00

[52] U.S. Cl. ..... 123/456; 285/156; 285/189; 137/561 A; 123/468; 123/470

[58] Field of Search ..... 123/456, 468, 469, 470, 123/471, 472; 285/156, 189, 330; 137/561 A, 883; 239/551, 600

[56] References Cited

U.S. PATENT DOCUMENTS

| | | | |
|---|---|---|---|
| 2,270,604 | 1/1942 | Roemhild | 285/331 |
| 3,912,165 | 10/1975 | Pira | 239/551 |
| 4,076,282 | 2/1978 | Scott, Jr. et al. | 285/156 |
| 4,257,559 | 3/1981 | Noren | 239/600 |
| 4,457,280 | 7/1984 | Hudson, Jr. | 123/468 |
| 4,570,600 | 2/1986 | Atkins | 123/456 |
| 4,649,884 | 3/1987 | Tuckey | 123/470 |
| 4,971,014 | 11/1990 | Usui | 239/551 |

FOREIGN PATENT DOCUMENTS

| | | | |
|---|---|---|---|
| 0802676 | 2/1951 | Fed. Rep. of Germany | 285/189 |
| 59-40577 | 3/1984 | Japan . | |

*Primary Examiner*—Carl S. Miller
*Assistant Examiner*—Erick Solis
*Attorney, Agent, or Firm*—Wenderoth, Lind & Ponack

[57] ABSTRACT

A fuel delivery rail assembly for supplying fuel to a plurality of fuel injectors in an engine is provided. The assembly comprises an elongated conduit having a rectangular section and a plurality of sockets. One wall of the conduit is provided with openings for receiving the sockets. Each opening is accompanied with a counter bore on its periphery. The counter bore is a stepped cut out portion within the wall thickness of the one wall. One end of each socket is tightly fixed within the counter bore.

2 Claims, 1 Drawing Sheet

FUEL DELIVERY RAIL ASSEMBLY

BACKGROUND OF THE INVENTION

This invention relates to a fuel delivery rail assembly for an internal combustion engine, especially for an automotive engine, equipped with a fuel injection system. The fuel delivery rail assembly delivers pressurized fuel supplied from a fuel pump toward intake passages or chambers via associated fuel injectors. The assembly is used to simplify installation of the fuel injectors and the fuel supply passages on the engine.

An ordinary fuel delivery rail assembly having a rectangular section is constructed as shown in FIG. 1 of the attached drawings. In this assembly, an elongated conduit 1 is formed by a steel tube having a rectangular hollow section. To an end of the conduit 1, a fuel inlet pipe 2 for introducing gasoline fuel is secured, and to the other end of the conduit 1, a fuel return pipe 3 leading to an exit for residual fuel is secured, both pipes being welded to the conduit by copper brazing. To the inside of the conduit 1 and the pipes 2, 3, copper plating or nickel plating is coated for protecting the surfaces from rust and for keeping the fuel clean.

The conduit 1 comprises four walls and a fuel passage therein (FIG. 2). To an outside surface of one wall 4, are attached a plurality of sockets 5, the number of which corresponds to the number of combustion cylinders. One end of each socket 5 communicates with the fuel passage 10, and the other end of each socket 5 is so formed as to receive an associated tip of a fuel injector. In most cases, these sockets 5 are inserted into guide holes arranged within the wall 4 of the conduit 1 at predetermined intervals, and welded thereto by copper brazing. The axial directions of the sockets 5 should precisely line up in alignment with the respective axial direction of the injectors. Furthermore, pitch lengths between adjacent sockets should precisely coincide with the corresponding pitch lengths between associated injectors. One of the objects of the present invention is directed to these alignment problems as discussed in detail below.

FIG. 4 shows a conventional connection between a fuel conduit 11 and a socket 15. For producing this kind of metallic socket 15, many kinds of working steps are needed. For example, at first a rough fabrication is made by a forging work, and then it is machined to make a form of an interior surface 16 and a stepped annular portion 17. The annular portion 17 is inserted into a guide hole 18 arranged in the wall 14 of the conduit 11. Then, copper brazing is applied to the abutment surface between the conduit 11 and the socket 15. Therefore, for making the complicated socket 15, many kinds of time-consuming working steps and transferring handling are needed, resulting in an increase of manufacturing cost.

FIG. 5 shows another conventional connection between a fuel conduit 21 and a socket 23, disclosed in Japanese utility model public disclosure No. 40577/1984. In this simple connection, a bottom surface of the socket 23 is secured to a wall surface of the conduit 21 in abutment relation therewith. Apparently, this connection cannot provide a precise alignment between the two parts, since the wall surface of the conduit 21 is not machined. Furthermore, there is no room for adjustment in assembling of the two parts.

SUMMARY OF THE INVENTION

It is an object of the present invention to overcome the above disadvantages in producing the fuel delivery rail assembly and to reduce the number of working steps.

Another object of the present invention is to improve alignment problems between adjacent sockets.

A further object of the present invention is to provide an economical fuel delivery rail assembly.

According to the invention, there is provided a fuel delivery rail assembly for an internal combustion engine comprising; an elongated conduit having a fuel passage of a generally rectangular hollow section, and a plurality of sockets perpendicularly attached to one wall of said conduit, one end of each socket communicating with said fuel passage, and the other end of each socket being so formed as to receive a fuel injector, said one wall of said conduit being provided with corresponding number of openings for receiving said one end of each socket, a counter bore being disposed on each periphery of said openings, said counter bore being formed as a stepped cut out portion within the wall thickness of said one wall, said other end of each socket being tightly fixed within said counter bore.

Within the scope of the invention, a counter bore is disposed on each periphery of the openings for receiving the sockets in fluid communication therethrough. The counter bore can be formed in a circular cavity or an annular slot. Since these counter bores can be precisely arranged in positions to be registered with the positions of the associated sockets, once the sockets are inserted into the counter bores, precise alignments are automatically obtained. If a further adjustment is needed, the sockets can be moved within the counter bores.

The sockets can be made from a steel pipe having a desirable outside diameter and a wall thickness through cutting and machining steps. Depending upon the original surface smoothness of the steel pipe, several machining steps are considerably simpified. By selecting a class of fit between the counter bore and the socket, the socket can be tightly fixed in position, thereby facilitating a following brazing work. During the brazing work, unexpected slip movement does not occur. Jig tools for brazing can be also simplified.

Other features and advantages of the invention will become apparent from a reading of the specification, when taken in conjunction with the drawings, in which, like reference numerals refer to like elements in the several views.

DESCRIPTION OF THE PREFERRED EMBODIMENT

Figure 1:
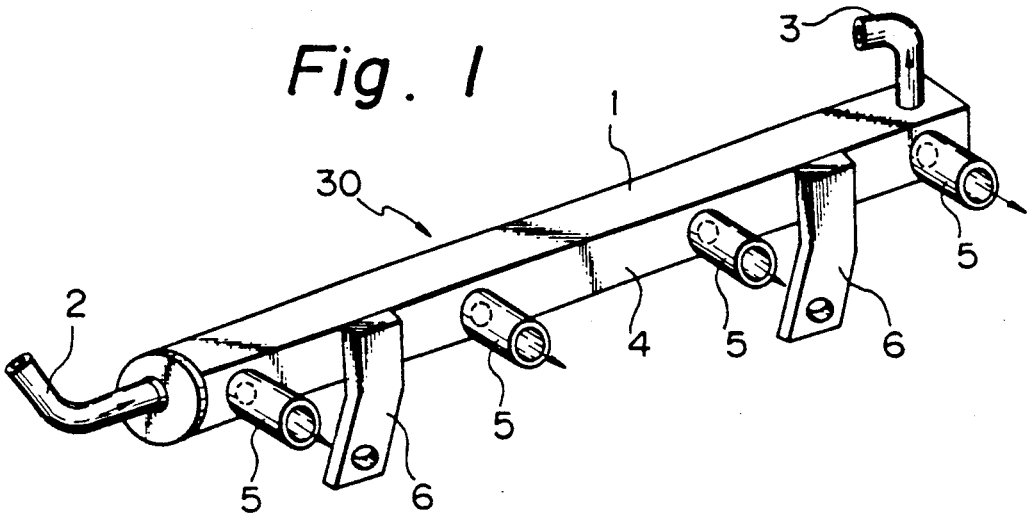
FIG. 1 is a perspective view of the fuel delivery rail assembly according to the invention.

Referring to FIG. 1, as stated above, there is shown a fuel delivery rail assembly 30, a preferable embodiment of the present invention, which is adapted to four cylinders on one side of an automotive V-8 engine. Outside appearance of the assembly 30 is similar to a conventional one. This assembly 30 comprises an elongated conduit 1 having a fuel inlet pipe 2 at an end and a fuel exit pipe 3 at the other end, and four sockets 5 attached to a side wall 4 of the conduit 1. The sockets 5 are disposed along the longitudinal direction of the conduit 1 at predetermined intervals so as to be registered with the positions of fuel injectors. To the side wall 4 of the conduit 1, rigid brackets 6 are fixed so as to mount the assembly 30 on the engine.

Figure 2:
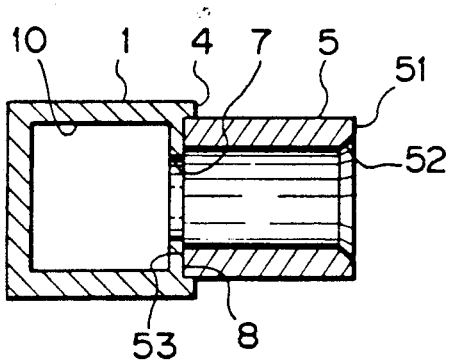
FIG. 2 is a vertical sectional view illustrating a connection between a fuel conduit and a socket.

As shown in the sectional view of FIG. 2, the section of the conduit 1 is formed into an essentially rectangular hollow shape having four walls, providing a fuel passage 10. Four side walls are integrally formed into a channel member, which can be produced by a process of steel plate roll forming or press working.

In the side wall 4, four circular openings 7 are disposed at predetermined intervals along the longitudinal direction of the conduit 1. At the periphery of each opening 7, a counter bore 8 in a form of a circular cavity is shaped by cutting out a portion of the wall thickness of the side wall 4.

The socket 5 is made from a regular steel pipe through cutting and machining steps. Adjacent the front end 51 of the socket 5, a chamfer 52 is formed, and the surface of the rear end 53 is formed into a sharp edge made by a cutting tool.

The interior diameter of the circular counter bore 8 is preferably selected in such a dimension as to establish a clearance fit between the outside diameter of the socket 5 and the counter bore 8. Thus, when the rear end 53 of the socket 5 is inserted into the counter bore 8, the socket 5 is held in its regular position, whereby a following step of brazing is considerably facilitated. When the brazing work is finished, a liquid-tight connection is completed.

Figure 3:
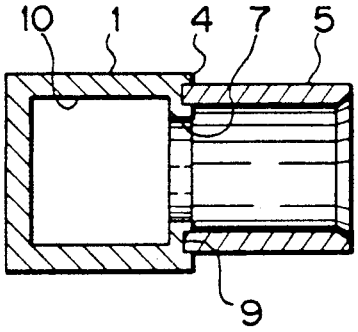
FIG. 3 is a vertical sectional view illustrating an alternative connection between a fuel conduit and a socket.
Figure 4:
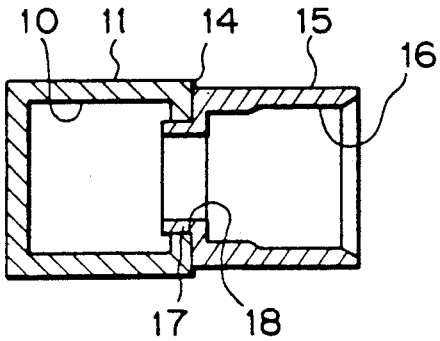
Fig. 4 PRIOR ART
FIG. 4 is a vertical sectional view of a conventional connection between a fuel conduit and a socket.
Figure 5:
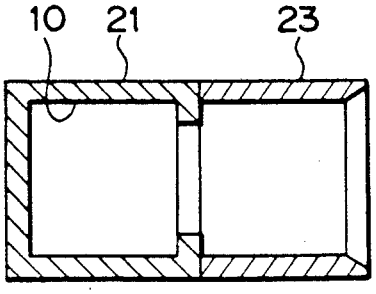
Fig. 5 PRIOR ART
FIG. 5 is a vertical sectional view of another conventional connection between a fuel conduit and a socket.

FIG. 3 shows an alternative embodiment of the invention. In this embodiment, at the periphery of the opening 7, a counter bore 9 in a form of an annular slot is shaped by cutting out a portion of the wall thickness of the side wall 4. The socket 5 is pressed into the counter bore 9 by force. As compared with the first embodiment, the socket 5 is more tightly held in its position by applying clearance fits on two surfaces, i.e. the outside diameter surface and the inside diameter surface of the socket 5. After the press fitting, copper brazing is applied to the peripheral surface, whereby a liquid-tight connection is completed.

In the above embodiments, the class of fit between the counter bore and the socket is preferably selected in a range of clearance fit and transition fit in order to establish a press fitting connection.

Thus, as is apparent from the above description, the fuel delivery rail assembly of the present invention can provide technical advantages as follows:

(a) Since many kinds of working and transferring steps can be saved, manufacturing process is considerably simplified.

(b) Since the sockets are inserted into the counter bores, the sockets are precisely positioned in their predetermined regular positions.

(c) Since the sockets are made from a steel pipe, an economical assembly is produced.

I claim:

1. A fuel delivery rail assembly for an internal combustion engine comprising;

an elongated conduit having a fuel passage of a generally rectangular hollow section, and a plurality of sockets perpendicularly attached to one wall of said conduit, one end of each socket communicating with said fuel passage, and the other end of each socket being so formed as to receive a fuel injector, said one wall of said conduit being provided with corresponding number of openings for receiving said one end of each socket, a counter bore being disposed on each periphery of said openings, said counter bore being formed as a stepped cut out portion within the wall thickness of said one wall, said other end of each socket being tightly fixed within said counter bore.

2. A fuel delivery rail assembly as claimed in claim 1, wherein said counter bore comprises an annular slot formed within said one wall.

* * * * *